US010933632B2

(12) United States Patent
Asamoto

(10) Patent No.: US 10,933,632 B2
(45) Date of Patent: Mar. 2, 2021

(54) LIQUID EJECTING DEVICE AND CONTROL DEVICE FOR LIQUID EJECTING DEVICE

(71) Applicant: SEIKO EPSON CORPORATION, Tokyo (JP)

(72) Inventor: Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/727,310

(22) Filed: Dec. 26, 2019

(65) Prior Publication Data

US 2020/0207079 A1 Jul. 2, 2020

(30) Foreign Application Priority Data

Dec. 27, 2018 (JP) ..... JP2018-246045

(51) Int. Cl.
*B41J 2/045* (2006.01)

(52) U.S. Cl.
CPC ..... *B41J 2/04553* (2013.01); *B41J 2/04566* (2013.01)

(58) Field of Classification Search
CPC ..... B41J 2/04553; B41J 2/04566
See application file for complete search history.

(56) References Cited

U.S. PATENT DOCUMENTS

2013/0148156 A1* 6/2013 Teraue ..... G06F 3/1257 358/1.15

FOREIGN PATENT DOCUMENTS

| | | |
|---|---|---|
| JP | 2005-262633 | 9/2005 |
| JP | 2007-050651 | 3/2007 |
| JP | 2010-030095 | 2/2010 |
| JP | 2015-158634 | 9/2015 |

* cited by examiner

*Primary Examiner* — Lamson D Nguyen
(74) *Attorney, Agent, or Firm* — Workman Nydegger

(57) ABSTRACT

A liquid ejecting device includes a housing, an ejecting unit located in the housing that ejects liquid onto a medium, and a display unit that displays a recommended condition of an installation environment where a device is installed. The display unit displays, as the recommended condition, any of (a) a recommended temperature condition indicating a recommended temperature range, (b) a recommended relative humidity condition indicating a recommended relative humidity range, (c) a recommended absolute humidity condition indicating a recommended absolute humidity range, and (d) a recommended temperature condition and a recommended absolute humidity condition.

13 Claims, 4 Drawing Sheets

LIQUID EJECTING DEVICE AND CONTROL DEVICE FOR LIQUID EJECTING DEVICE

The present application is based on, and claims priority from JP Application Serial Number 2018-246045, filed Dec. 27, 2018, the disclosure of which is hereby incorporated by reference herein in its entirety.

BACKGROUND

The present disclosure relates to a liquid ejecting device and a control device for a liquid ejecting device.

JA-A-2007-50651 describes a printing system including a printing machine that is an example of a liquid ejecting device. The printing system displays the recommended temperature condition and recommended relative humidity condition of the environment where the printing machine is installed to ensure proper operation of the printing machine.

SUMMARY

Relative humidity is dependent on temperature. If the temperature of the installation environment is adjusted to satisfying the recommended temperature condition after the relative humidity of the installation environment is adjusted to satisfy the recommended relative humidity condition, the relative humidity of the installation environment changes. In this case, it may be necessary to readjust the relative humidity of the installation environment to satisfy the recommended relative humidity condition. The relative humidity is linked in this way with the temperature, and this may cause confusion in the user who adjusts the installation environment of the printing machine.

A liquid ejecting device according to one embodiment includes a housing, an ejecting unit located in the housing, the ejecting unit being configured to eject liquid onto a medium, and a display unit configured to display a recommended condition of an installation environment where a device is installed. The display unit displays as the recommended condition any of (a) a recommended temperature condition indicating a recommended temperature range, (b) a recommended relative humidity condition indicating a recommended relative humidity range, (c) a recommended absolute humidity condition indicating a recommended absolute humidity range, and (d) the recommended temperature condition and the recommended absolute humidity condition.

A liquid ejecting device according to another embodiment includes a housing, an ejecting unit located in the housing, the ejecting unit being configured to eject liquid onto a medium, a control unit configured to acquire a parameter indicating an installation environment where the liquid ejecting device is installed, a display unit. The control unit causes the display unit to display a display prompting adjustment of the installation environment, based on the parameter and, a recommended absolute humidity condition, as a recommended condition of the installation environment, indicating a recommended absolute humidity range.

In another embodiment, a control device of a liquid ejecting device, the control device being configured to communicate with the liquid ejecting device including a housing, an ejecting unit located in the housing, the ejecting unit being configured to eject liquid onto a medium, a control unit configured to acquire a parameter indicating an installation environment where a device is installed, and a display unit. The control device observes a state variable of a temperature and an absolute humidity of the installation environment; after a prompt for adjustment of the installation environment, acquires absolute humidity change information related to a change in the absolute humidity of the installation environment; learns a condition associated with a change in the absolute humidity of the installation environment after a prompt for adjustment of the installation environment, according to a training data set created based on a combination of the state variable, content of processing of prompting adjustment of the installation environment, and the absolute humidity change information; and based on the condition, causes the control unit to perform processing of causing the display unit to display information based on the state variable, the content of the processing of prompting adjustment of the installation environment, and the absolute humidity change information.

DESCRIPTION OF EXEMPLARY EMBODIMENTS

First Embodiment

A liquid ejecting device according to a first embodiment will be described below with reference to the drawings. The liquid ejecting device is, for example, an ink jet-type printer that records an image such as characters and photographs on a medium such as a sheet by ejecting ink, which is an example of a liquid.

Figure 1:
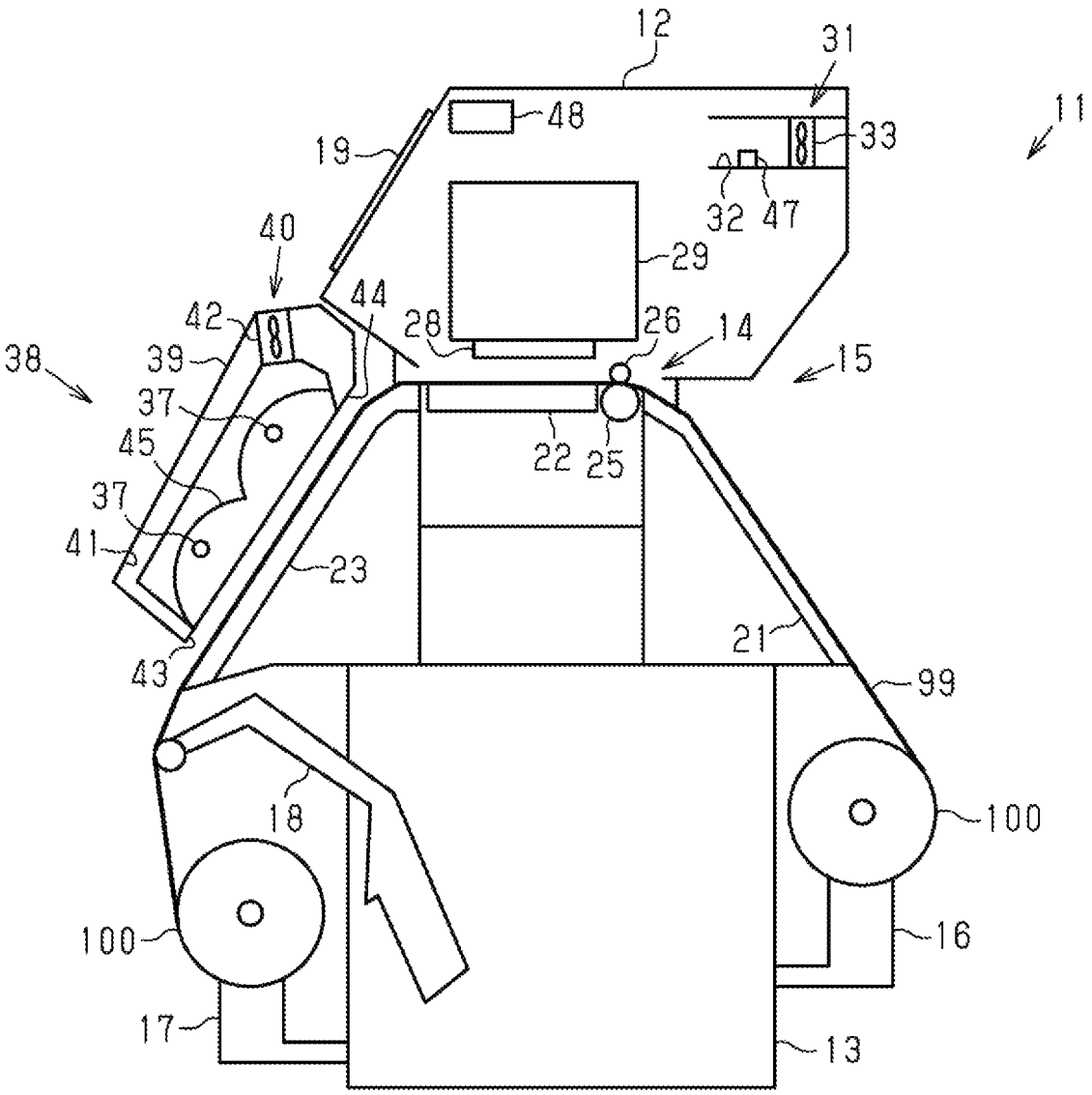
FIG. 1 is a side view schematically illustrating a first embodiment of a liquid ejecting device.

As illustrated in FIG. 1, a liquid ejecting device 11 includes a housing 12. The liquid ejecting device 11 includes a base 13 that supports the housing 12. In the first embodiment, the housing 12 is positioned above the base 13.

The liquid ejecting device 11 includes a display unit 19. The display unit 19 displays information related to the liquid ejecting device 11. The display unit 19 of the first embodiment is, for example, a liquid crystal screen. The display unit 19 is provided, for example, on the housing 12. Note that the display unit 19 in the present embodiment is provided on the housing 12, but the display unit 19 may be independent from the housing 12.

The liquid ejecting device 11 of the first embodiment includes a transport unit 14 that transports a medium 99. The transport unit 14 is provided in the housing 12. The transport unit 14 transports the medium 99 placed outside the housing 12 along a transport path 15.

The liquid ejecting device 11 may include a placement unit 16 on which a roll body 100 of the wound medium 99 is placed. The placement unit 16 may be attached to the base 13, for example. The placement unit 16 supports the roll body 100 of the wound medium 99 onto which liquid has not been ejected in a rotatably manner. When the transport unit 14 is driven, the medium 99 is fed from the roll body 100.

The liquid ejecting device 11 may be configured to eject liquid onto the medium 99 fed from the roll body 100 placed on an installation surface on which the liquid ejecting device 11 is installed. The liquid ejecting device 11 may be configured to eject liquid onto the medium 99 fed from a device other than the liquid ejecting device 11. The liquid ejecting device 11 is not limited to a configuration in which liquid is ejected onto the medium 99 fed from the roll body 100.

The liquid ejecting device 11 may include a winding unit 17 that winds the medium 99 on which recording took place. The winding unit 17 may be attached to the base 13, for example. The winding unit 17 winds the medium 99, on which liquid has been ejected, as the roll body 100. The liquid ejecting device 11 may be configured to transport the medium 99 on which liquid has been ejected to a device other than the liquid ejecting device 11. The liquid ejecting device 11 may be configured to wind the medium 99 on which liquid has been ejected on a device other than the liquid ejecting device 11.

The liquid ejecting device 11 may include a tension bar 18 that provides tension to the medium 99. The tension bar 18 applies tension to the medium 99 by coming into contact with the medium 99. By applying tension to the medium 99 with the tension bar 18, liquid can accurately land on the medium 99.

The tension bar 18 may be attached to the base 13, for example. The tension bar 18 attached to the base 13 in a manner allowing for its position to be changed. In this way, by changing the position of the tension bar 18, the amount of the tension applied to the medium 99 can be adjusted.

The liquid ejecting device 11 of the first embodiment includes a first support portion 21, a second support portion 22, and a third support portion 23 that constitute the transport path 15. The first support portion 21, the second support portion 22, and the third support unit 23 support the medium 99 transported by the transport unit 14. The first support portion 21, the second support portion 22, and the third support portion 23 are arranged in that order from the upstream to the downstream of the transport path 15. That is, the first support portion 21 constitutes an upstream portion of the transport path 15, the second support portion 22 constitutes a midstream portion of the transport path 15, and the third support portion 23 constitutes a downstream portion of the transport path 15. The second support portion 22 is located in the housing 12.

The transport unit 14 of the first embodiment includes a first roller 25 and a second roller 26. The first roller 25 and the second roller 26 transport the medium 99 by rotating while sandwiching the medium 99. The first roller 25 and the second roller 26 are positioned sandwiching the medium 99 between the first support portion 21 and the second support portion 22 along the transport path 15.

The liquid ejecting device 11 includes a ejecting unit 28 that ejects liquid onto the medium 99. The ejecting unit 28 is located in the housing 12. The ejecting unit 28 of the first embodiment is positioned at a position facing the second support portion 22. Thus, the ejecting unit 28 ejects liquid onto a portion of the medium 99 supported by the second support unit 22.

The liquid ejecting device 11 of the first embodiment includes a carriage 29 on which the ejecting unit 28 is mounted. The carriage 29 scans the transported medium 99. In other words, the liquid ejecting device 11 of the first embodiment is a serial printer in which the ejecting unit 28 scans the medium 99. The liquid ejecting device 11 may be a line printer in which the ejecting unit 28 has a long length.

The liquid ejecting device 11 of the first embodiment includes an intake mechanism 31 that introduces outside air from outside the housing 12 into the housing 12. The intake mechanism 31 includes an intake path 32 and a fan 33, for example. The fan 33 is located in the intake path 32. When the fan 33 is driven, outside air from outside the housing 12 is taken into the housing 12 through the intake path 32. The inside of the housing 12 can be ventilated by the intake mechanism 31.

The liquid ejecting device 11 may include a heater 37 that heats the medium 99. The heater 37 is located downstream from the position where the liquid is ejected by the ejecting unit 28 along the transport path 15. Thus, the heater 37 heats a portion of the medium 99 onto which liquid has been ejected. The medium 99 onto which liquid has been ejected can be dried by the heater 37.

The heater 37 of the first embodiment is a heater tube. The heater 37 is positioned facing a surface of the third support unit 23, which is the surface of the third support portion 23 that comes into contact with the medium 99. The heater 37 heats a portion of the medium 99 supported by the third support portion 23. Accordingly, a portion of the medium 99 onto which liquid has been ejected is dried. The heater 37 is controlled to properly dry a portion of the medium 99 onto which liquid has been ejected. For example, the heater 37 is controlled based on the amount of liquid ejected onto the medium 99. In this case, the greater the amount of liquid ejected onto the medium 99, the greater the output of the heater 37.

The liquid ejecting device 11 of the first embodiment includes a drying mechanism 38 that includes the heater 37. The drying mechanism 38 includes a case 39 that houses the heater 37 and a circulation unit 40 that circulates gas within the case 39. The case 39 is positioned facing the third support portion 23.

The circulation unit 40 includes a circulation path 41 through which gas flows, and a fan 42 located in the circulation path 41. The circulation path 41 is a flow path connecting an intake port 43 that introduces gas and a blowing port 44 that sends out gas. The circulation path 41 extends around the heater 37. The intake port 43 is positioned facing a downstream portion of the third support portion 23 along the transport path 15. The blowing port 44 is positioned facing an upstream portion of the third support portion 23 along the transport path 15. The circulation unit 40 circulates the gas heated by the heater 37 within the case 39. This facilitates drying of the medium 99.

The drying mechanism 38 may include a reflecting plate 45 that reflects the heat of the heater 37 toward the third support portion 23. In this way, the heat of the heater 37 can be efficiently conveyed to the medium 99.

The liquid ejecting device 11 may include a detection unit 47 that detects the installation environment in which the liquid ejecting device 11 is installed. The detection unit 47 may be configured to detect the temperature of the installation environment, or may be configured to detect the relative humidity of the installation environment. The detection unit 47 may be configured to detect both the temperature of the installation environment and the relative humidity of the installation environment. In this case, the absolute humidity of the installation environment can be ascertained from the detection result of the detection unit 47. The detection unit 47 may be configured to directly detect the absolute humidity of the installation environment.

The detection unit 47 of the first embodiment is located in the intake path 32. In this way, outside air is taken up by the fan 33, and thus the installation environment can be efficiently detected by the detection unit 47. The detection unit 47 is required to be provided at a position where it can detect the installation environment and may be attached to the base 13, for example.

The liquid ejecting device 11 includes a control unit 48. The control unit 48 of the first embodiment comprehensively controls the liquid ejecting device 11. The control unit 48 is constituted by a CPU, memory, and the like, for example. The control unit 48 controls the liquid ejecting device 11 by the CPU executing a program stored in the memory.

The control unit 48 of the first embodiment acquires a parameter indicating the installation environment. The control unit 48 may acquire a parameter indicating the installation environment from the detection result detected by the detection unit 47. In other words, the control unit 48 may acquire the temperature of the installation environment, or may acquire the relative humidity of the installation environment, or may acquire the absolute humidity of the installation environment from the detection result detected by the detection unit 47. The control unit 48 may acquire the absolute humidity of the installation environment based on the acquired temperature of the installation environment and the relative humidity of the installation environment.

The control unit 48 may acquire a parameter indicating the installation environment from information input from the user, for example. A temperature measured by the user using a thermometer may be input into the control unit 48, or a relative humidity measured by the user using a relative humidity meter may be input into the control unit 48. An absolute humidity measured by the user using an absolute humidity meter may be input into the control unit 48. In this case, to perform input into the control unit 48, the user may operate the liquid ejecting device 11, or the user may operate an external device configured to communicate with the liquid ejecting device 11. Information of the installation environment detected by an external device configured to communicate with the liquid ejecting device 11 may be input into the control unit 48.

Generally, in the liquid ejecting device 11, a recommended installation environment recommended condition is determined. With the recommended condition of the installation environment being satisfied, the liquid ejecting device 11 can properly record an image. For, example, with the recommended condition of the installation environment being satisfied, the liquid ejecting device 11 can record a high quality image.

The display unit 19 may display the recommended condition of the recommended installation environment. In this way, the user can adjust the installation environment to satisfy the recommended condition by confirming the recommended condition displayed on the display unit 19.

The display unit 19 may display a recommended temperature condition indicating the recommended temperature range as the recommended condition. For example, the display unit 19 displays the recommended temperature range as "from 20° C. to 23° C." as the recommended temperature condition. In this case, the user adjusts the installation environment so that the temperature of the installation environment is within the range of from 20° C. to 23° C. In this case, the installation environment is easily adjusted by the user by simply adjusting the temperature.

The display unit 19 may display a recommended relative humidity condition indicating the recommended relative humidity range as the recommended condition. For example, the display unit 19 displays the recommended relative humidity range as "from 50% to 58%" as the recommended relative humidity condition. In this case, the user adjusts the installation environment so that the relative humidity of the installation environment is within the range of from 50% to 58%. In this case, the installation environment is easily adjusted by the user by simply adjusting the relative humidity.

The display unit 19 may display a recommended absolute humidity condition indicating the recommended absolute humidity range as the recommended condition. For example, the display unit 19 displays the recommended absolute humidity range as "from 8.7 g/m$^3$ to 11.9 g/m$^3$" as the recommended absolute humidity condition. In this case, the user adjusts the installation environment so that the absolute humidity of the installation environment is within the range of from 8.7 g/m$^3$ to 11.9 g/m$^3$. In this case, the installation environment is easily adjusted by the user by simply adjusting the absolute humidity.

The display unit 19 may display a recommended temperature condition and a recommended absolute humidity condition as the recommended condition. For example, the display unit 19 displays the recommended temperature range as "from 20° C. to 23° C." and the recommended absolute humidity range as "from 8.7 g/m$^3$ to 11.9 g/m$^3$" as the recommended absolute humidity condition. In this case, the user adjusts the installation environment so that the temperature is within the range of from 20° C. to 23° C. and the absolute humidity is within the range of from 8.7 g/m$^3$ to 11.9 g/m$^3$.

Temperature and absolute humidity are parameters independent of each other. As such, the user can independently adjust the temperature and the absolute humidity. Heating may be turned on to increase the temperature, and cooling may be turned on to decrease the temperature. Humidification may be used to increase the absolute humidity, and dehumidification may be used to decrease the absolute humidity.

Relative humidity is a parameter that is temperature dependent. As such, the relative humidity also changes when the temperature changes. For example, in a case where the display unit 19 displays the recommended temperature condition and the recommended relative humidity condition as the recommended condition, the user adjusts the installation environment so that the temperature and the relative humidity satisfy the recommended condition. Here, when the temperature is adjusted after the relative humidity is adjusted, adjusting the temperature changes the relative humidity. In this case, it may be necessary to readjust the relative humidity. In addition, even though the recommended condition can be satisfied by simply adjusting the temperature, the relative humidity may be needlessly adjusted. In contrast, displaying the above-described recommended condition makes it easy for the user to adjust the installation environment.

The control unit 48 may compare the obtained parameter with the recommended condition. In this case, the control unit 48 stores the recommended condition. The control unit 48 determines whether the installation environment satisfies the recommended condition based on the acquired parameter and the recommended condition. When the installation environment does not satisfy the recommended condition, the control unit 48 of the first embodiment prompts the installation environment to be adjusted. In the first embodiment, the control unit 48 stores the recommended temperature condition and the recommended absolute humidity conditions as the recommended condition.

Figure 2:
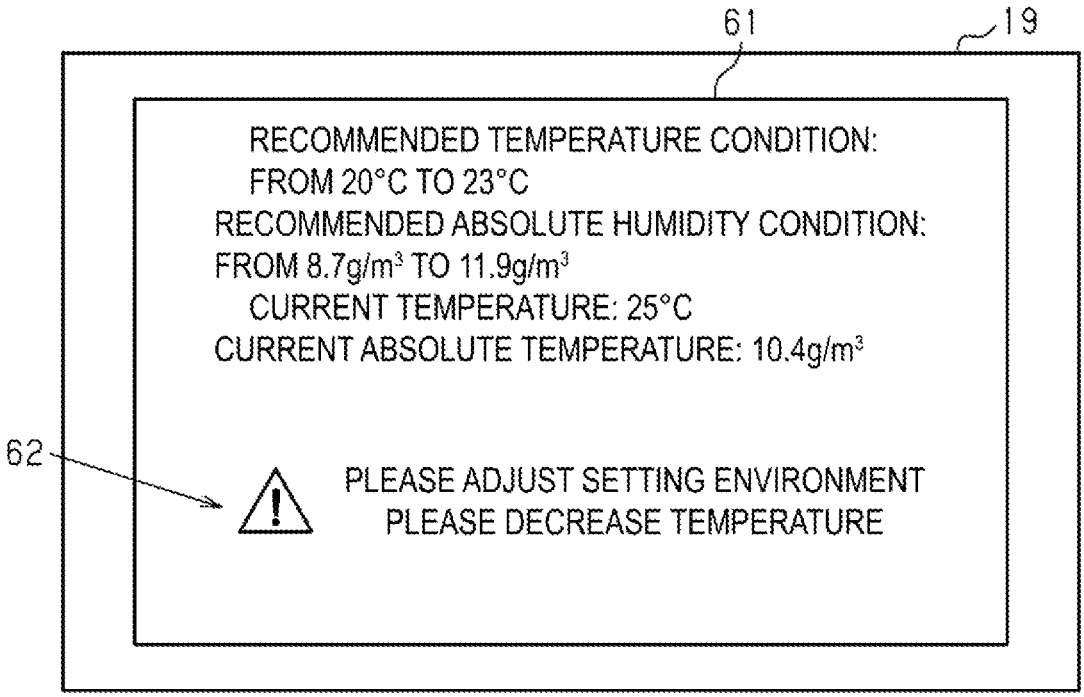
FIG. 2 is a schematic view of a display screen.

As illustrated in FIG. 2, the display unit 19 displays a display screen 61. The recommended condition is displayed on the display screen 61, for example. In the first embodiment, the recommended temperature condition and the recommended absolute humidity condition are displayed on the display screen 61. A parameter indicating the installation environment may be displayed on the display screen 61. In the first embodiment, the control unit 48 causes the display unit 19 to display the acquired parameter. Thus, the temperature of the installation environment and the absolute humidity of the installation environment are displayed on the display screen 61. In this way, the user can adjust the installation environment to satisfy the recommended condition by looking at the display screen 61.

The control unit 48 of the first embodiment determines whether the installation environment satisfies the recommended temperature condition based on the temperature and the recommended temperature condition of the installation environment. Here, the control unit 48 compares the temperature to the recommended temperature condition of the installation environment. The control unit 48 of the first embodiment determines whether the installation environment satisfies the recommended absolute humidity condition based on the absolute humidity and the recommended absolute humidity condition of the installation environment. Here, the control unit 48 compares the absolute humidity to the recommended absolute humidity of the installation environment. In other words, the control unit 48 of the first embodiment determines whether the installation environment satisfies both the recommended temperature condition and the recommended absolute humidity condition.

The control unit 48 causes the display unit 19 to display a display prompting the installation environment to be adjusted. In the first embodiment, when the installation environment does not satisfy the recommended condition, an adjustment message 62 prompting the installation environment to be adjusted is displayed on the display screen 61. The user confirms the adjustment message 62 and adjusts the installation environment.

The control unit 48 of the first embodiment causes the display unit 19 to display a display prompting humidification or dehumidification as the display prompting the installation environment to be adjusted. For example, when the absolute humidity of the installation environment exceeds the recommended absolute humidity condition, a display prompting the dehumidification of the installation environment is caused to be displayed on the display unit 19 as the adjustment message 62. When the absolute humidity of the installation environment is below the recommended absolute humidity condition, a display prompting the humidification of the installation environment is caused to be displayed on the display unit 19 as the adjustment message 62.

The control unit 48 of the first embodiment causes the display unit 19 to display a display prompting heating or cooling as the display prompting the installation environment to be adjusted. For example, when the temperature of the installation environment exceeds the recommended temperature condition, a display prompting the cooling of the installation environment is caused to be displayed on the display unit 19 as the adjustment message 62. When the temperature of the installation environment is below the recommended temperature condition, a display prompting the heating of the installation environment is caused to be displayed on the display unit 19 as the adjustment message 62. When both the recommended temperature condition and the recommended absolute humidity condition of the installation environment are not satisfied, a display prompting the humidification or dehumidification of the installation environment and a display prompting the heating or cooling of the installation environment are displayed on the display unit 19 as the adjustment message 62.

The control unit 48 may store an adjustable range of a parameter indicating the installation environment. In such an embodiment, the control unit 48 may prompt adjustment of the installation environment within the adjustable range in a case that the parameter does not satisfy the recommended condition. The adjustable range is stored in the control unit 48 by the user entering the adjustable range into the control unit 48. For example, when an adjustable range of the temperature of the installation environment from 17° C. to 22° C. is stored, and an adjustable range of the absolute humidity of the installation environment from 2.0 $g/m^3$ to 8.0 $g/m^3$ is stored, the control unit 48 can recognize when the recommended absolute humidity condition of the installation environment cannot be satisfied by adjusting the absolute humidity within the adjustable range. Thus, when the recommended absolute humidity condition of the installation environment is not satisfied, the control unit 48 may not prompt adjusting the absolute humidity. When the installation environment does not satisfy the recommended condition, the control unit 48 prompts adjustment of the temperature. Storing the adjustable range of the parameter is advantageous in cases in which there are limitations in adjusting the temperature and the absolute humidity, such as when there is an air conditioner but not a humidifier as a means of adjusting the installation environment, or when there is an air conditioner with low cooling and heating capacity and a humidifier with low humidifying capacity as a means of adjusting the installation environment.

The control unit 48 of the first embodiment executes adjustment processing of adjusting the installation environment. In the first embodiment, the adjustment processing may be executed repeatedly at predetermined time intervals while the liquid ejecting device 11 is operating, or may be executed when job data for recording an image is input.

Figure 3:
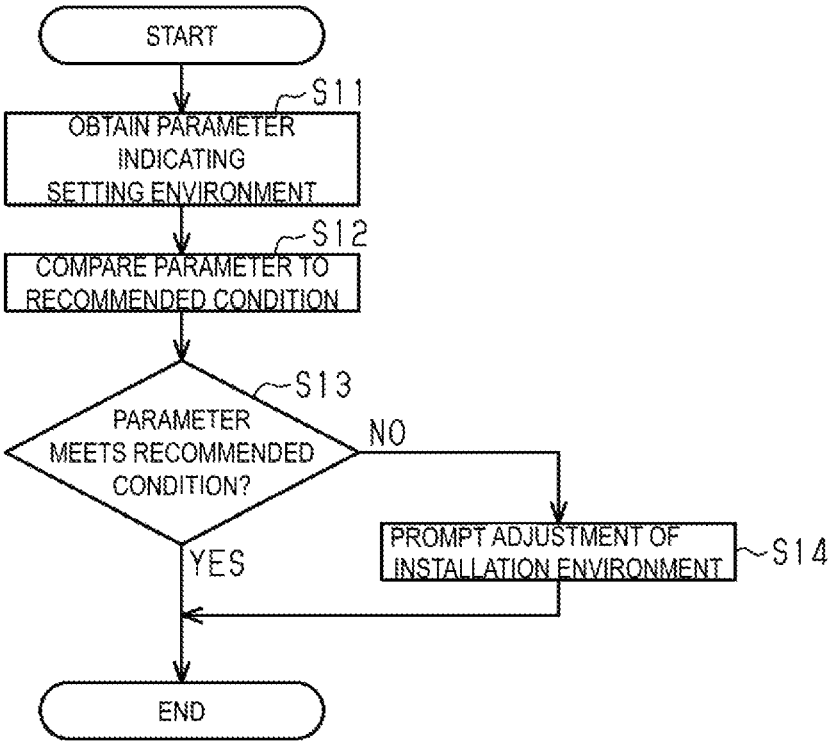
FIG. 3 is a flowchart of adjustment processing.

As illustrated in FIG. 3, the control unit 48 that executes the adjustment processing acquires a parameter indicating the installation environment in step S11. In the first embodiment, the temperature of the installation environment and the relative humidity of the installation environment are acquired from the detection result of the detection unit 47. The control unit 48 acquires the absolute humidity of the installation environment from the acquired temperature and relative humidity. When the processing of step S11 is finished, the control unit 48 transitions the processing to step S12.

In step S12, the control unit 48 compares the obtained parameter to the stored recommended condition. In the first embodiment, the temperature is compared to the recommended temperature condition and the absolute humidity is compared to the recommended absolute humidity condition. When the processing of step S12 is finished, the control unit 48 transitions the processing to step S13.

In step S13, the control unit 48 determines whether the parameter satisfies the recommended condition. If the parameter satisfies the recommended condition, the control unit 48 ends the adjustment processing. In the first embodiment, the adjustment processing is ended when the temperature satisfies the recommended temperature condition and the absolute humidity satisfies the recommended absolute humidity condition. If the parameter does not satisfy the recommended condition, the control unit 48 transitions the processing to step S14. In other words, if the temperature does not satisfy the recommended temperature condition or the absolute humidity does not satisfy the recommended absolute humidity condition, the control unit 48 transitions the processing to step S14.

In step 14, the control unit 48 prompts adjustment of the setting environment. Here, the control unit 48 prompts adjustment of the setting environment based on the parameter and the recommended condition. For example, when the temperature does not satisfy the recommended temperature condition, the control unit 48 prompts adjustment of the temperature. When the absolute humidity does not satisfy the recommended absolute humidity condition, the control unit 48 prompts adjustment of the absolute humidity. When the processing of step S14 is finished, the control unit 48 ends the processing.

The display of the display unit 19 may be controlled by a machine learning unit that machine learns. For example, the control unit 48 of the liquid ejecting device 11 may function as a machine learning unit. In this case, the control unit 48 observes a state variable of the temperature of the installation environment and the absolute humidity of the installation environment, and acquires absolute humidity change information related to the change in the absolute humidity of the installation environment after adjustment of the installation environment has been prompted. The control unit 48 learns the condition associated with the change in absolute humidity of the installation environment after the prompt for adjusting of the installation environment according to a training data set created based on the combination of the state variable, the content of processing of prompting adjustment of the installation environment, and the absolute humidity change information. The control unit 48, based on the learnt condition, displays on the display unit 19 information based on the state variable, the content of processing of prompting adjustment of the installation environment, and the absolute humidity change information. In this way, information making it easy for the user to adjust the installation environment for the user can be displayed on the display unit 19.

Figure 4:
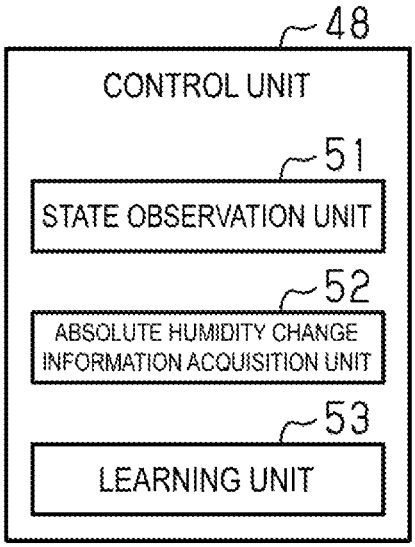
FIG. 4 is a block diagram of a control unit.

As illustrated in FIG. 4, the control unit 48 functioning as a machine learning unit includes a state observation unit 51, an absolute humidity change information acquisition unit 52, and a learning unit 53. The state observation unit 51 observes a state variable configured from the temperature of the installation environment and the absolute humidity of the installation environment. The state observation unit 51 of the first embodiment observes the temperature of the installation environment and the absolute humidity of the installation environment from the detection result of the detection unit 47.

The absolute humidity change information acquisition unit 52 acquires absolute humidity change information related to the change in absolute humidity of the installation environment after the prompt for adjustment of the installation environment. The absolute humidity change information is information obtained by the control unit 48 comparing the absolute humidity of the installation environment before the prompt for adjustment and the absolute humidity of the installation environment after the prompt for adjustment. In other words, the absolute humidity change information is information indicating how the absolute humidity has changed due to the adjustment of the installation environment.

The learning unit 53 learns the condition associated with the change in absolute humidity after the prompt for adjusting of the installation environment according to a training data set created based on the combination of the state variable observed by the state observation unit 51, the content of processing of prompting adjustment of the installation environment, and the absolute humidity change information acquired by the absolute humidity change information acquisition unit 52. In the first embodiment, the content of processing of prompting adjustment of the installation environment is the adjustment message 62 displayed on the display unit 19. Any learning algorithm may be used by the learning unit 53. Examples of learning algorithms include, for example, supervised learning, non-supervised learning, and enhanced learning.

The control unit 48, based on the condition associated with the change in the absolute humidity after the prompt for adjustment of the installation environment, displays on the display unit 19 information based on the state variable, the content of processing of prompting adjustment of the installation environment, and the absolute humidity change information. For example, the control unit 48 displays a display on the display unit 19 prompting the installation environment to be adjusted based on the condition learned by the learning unit 53.

Figure 5:
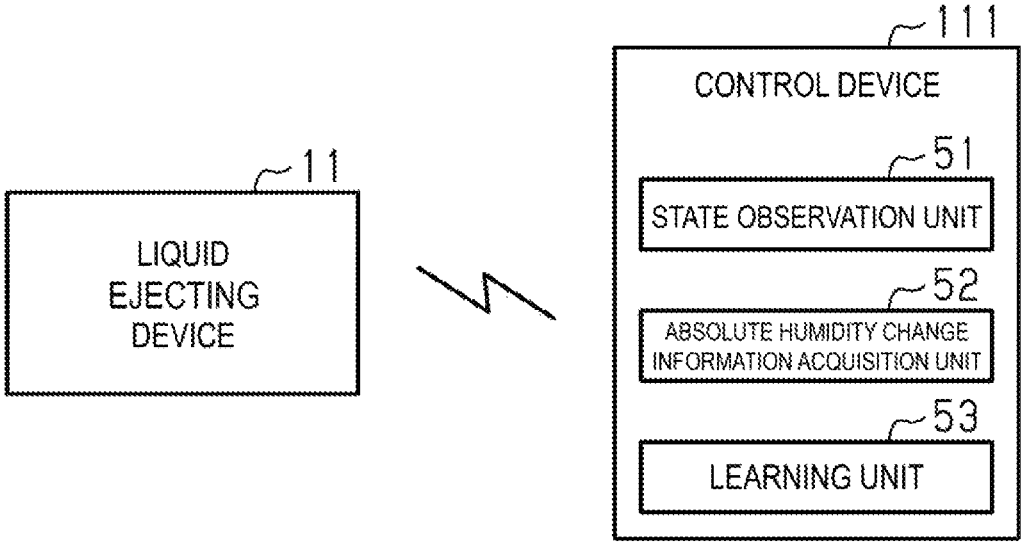
FIG. 5 is a block diagram of a control device that controls a liquid ejecting device.

As illustrated in FIG. 5, a control device 111 configured to communicate with the liquid ejecting device 11 may function as a machine learning unit. The control device 111 is configured to control the liquid ejecting device 11 by being connected to the liquid ejecting device 11. The control device 111 is a computer, for example, and includes a CPU, a memory, and the like. The control device 111 includes the state observation unit 51, the absolute humidity change information acquisition unit 52, and the learning unit 53.

The control device 111 observes a state variable configured from the temperature and the absolute humidity of the installation environment, and acquires absolute humidity change information related to the change in the absolute humidity of the installation environment after adjustment of the installation environment has been prompted. The control device 111 learns the condition associated with the change in absolute humidity of the installation environment after the prompt for adjusting of the installation environment according to a training data set created based on the combination of the state variable, the content of processing of prompting adjustment of the installation environment, and the absolute humidity change information. The control device 111, based on the learnt condition, causes the control unit 48 to perform the processing of causing the display unit 19 to display information based on the state variable, the content of processing of prompting adjustment of the installation environment, and the absolute humidity change information. In this way, information making it easy for the user to adjust the installation environment can be displayed.

Next, the functions and effects of the first embodiment will be described.

(1) The display unit 19 displays, as a recommended condition, any of (a) a recommended temperature condition indicating a recommended temperature range, (b) a recommended relative humidity condition indicating a recommended relative humidity range, (c) a recommended absolute humidity condition indicating a recommended absolute humidity range, and (d) the recommended temperature condition indicating a recommended temperature range and the recommended absolute humidity condition indicating a recommended absolute humidity range.

Generally, in the liquid ejecting device 11, a recommended installation environment recommended condition is determined to ensure proper operation. In a case where the display unit 19 displays a recommended temperature condition as the recommended condition, the user adjusts the installation environment so that the temperature of the installation environment satisfies the recommended temperature condition. In a case where the display unit 19 displays a recommended relative humidity as the recommended condition, the user adjusts the installation environment so that the relative humidity of the installation environment satisfies the recommended relative humidity condition. In a case where the display unit 19 displays a recommended absolute humidity as the recommended condition, the user adjusts the installation environment so that the absolute humidity of the installation environment satisfies the recommended absolute humidity condition. In this way, when the display unit 19 displays any of the conditions (a), (b), or (c), the installation environment can be easily adjusted by the user because there is only one parameter to adjust.

In a case where the display unit 19 displays a recommended temperature condition and a recommended absolute humidity as the recommended condition, the user adjusts the installation environment so that the temperature of the installation environment satisfies the recommended temperature and the absolute humidity of the installation environment satisfies the recommended absolute humidity condition. Relative humidity is temperature dependent, whereas absolute humidity is not temperature dependent. That is, temperature and absolute humidity are each independent. As such, the user can separately adjust the temperature and the absolute humidity. In this way, when the display unit 19 displays the condition (d), the installation environment can be easily adjusted by the user because the two parameters to be adjusted are independent of one another.

(2) The control unit 48 compares the obtained parameter to the stored recommended condition, and in a case that the parameter does not satisfy the recommended condition, the control unit 48 prompts adjustment of the installation environment. This allows the user to know whether the installation environment needs to be adjusted.

(3) The control unit 48 stores the absolute humidity condition as a recommended condition, and prompts adjustment of the installation environment, based on the parameter and the absolute humidity condition. This allows the user to know whether the installation environment needs to be adjusted based on the absolute humidity condition.

(4) The control unit 48 causes the display unit 19 to display at least one of (e) a display prompting the humidification or dehumidification of the installation environment, or (f) a display prompting the heating or cooling of the installation environment, or combination thereof. This allows the user to know the specific method for adjusting the installation environment.

(5) The control unit 48 acquires a parameter from the detection result detected by the detection unit 47. In this way, the control unit 48 can acquire a parameter indicating the installation environment without going through an external device.

(6) The control unit 48 prompts adjustment of the installation environment within the adjustable range in a case that the parameter does not satisfy the recommended condition. Accordingly, adjustment to a proper installation environment can be prompted for based on an adjustable range.

(7) The control unit 48 observes the state variable of the temperature and the absolute humidity of the installation environment; after a prompt for the adjustment of the installation environment, acquires the absolute humidity change information related to a change in the absolute humidity of the installation environment; learns the condition associated with the change in absolute humidity of the installation environment after the prompt for adjusting of the installation environment according to a training data set created based on the combination of the state variable, the content of processing of prompting adjustment of the installation environment, and the absolute humidity change information; and, based on the condition, causes the display unit 19 to display the information based on the state variable, the content of processig prompting adjustment of the installation environment, and the absolute humidity change information. In this way, information making it easy for the user to adjust the installation environment can be displayed.

(8) The control device 111 observes the state variable of the temperature and the absolute humidity of the installation environment; after a prompt for the adjustment of the installation environment, acquires the absolute humidity change information related to a change in the absolute humidity of the installation environment; learns the condition associated with the change in absolute humidity of the installation environment after the prompt for adjusting of the installation environment according to a training data set created based on the combination of the state variable, the content of processing of prompting adjustment of the installation environment, and the absolute humidity change information; and, based on the condition; causes the control unit 48 to perform processing of causing the display unit 19 to display the information based on the state variable, the content of processing of prompting adjustment of the installation environment, and the absolute humidity change information. In this way, information making it easy for the user to adjust the installation environment can be displayed.

Second Embodiment

Next, a second embodiment of the liquid ejecting device 11 will be described. The second embodiment has the same configuration as the first embodiment, except that the recommended condition stored by the control unit 48 is different. Accordingly, the configuration of the second embodiment which is different from that of the first embodiment will be mainly described. The control unit 48 of the second embodiment stores the recommended absolute humidity conditions as the recommended condition.

The control unit 48 of the second embodiment determines whether the installation environment satisfies the recommended absolute humidity condition based on the acquired parameter and the recommended absolute humidity condition. Here, the control unit 48 compares the acquired absolute humidity to the recommended absolute humidity of the installation environment.

Figure 6:
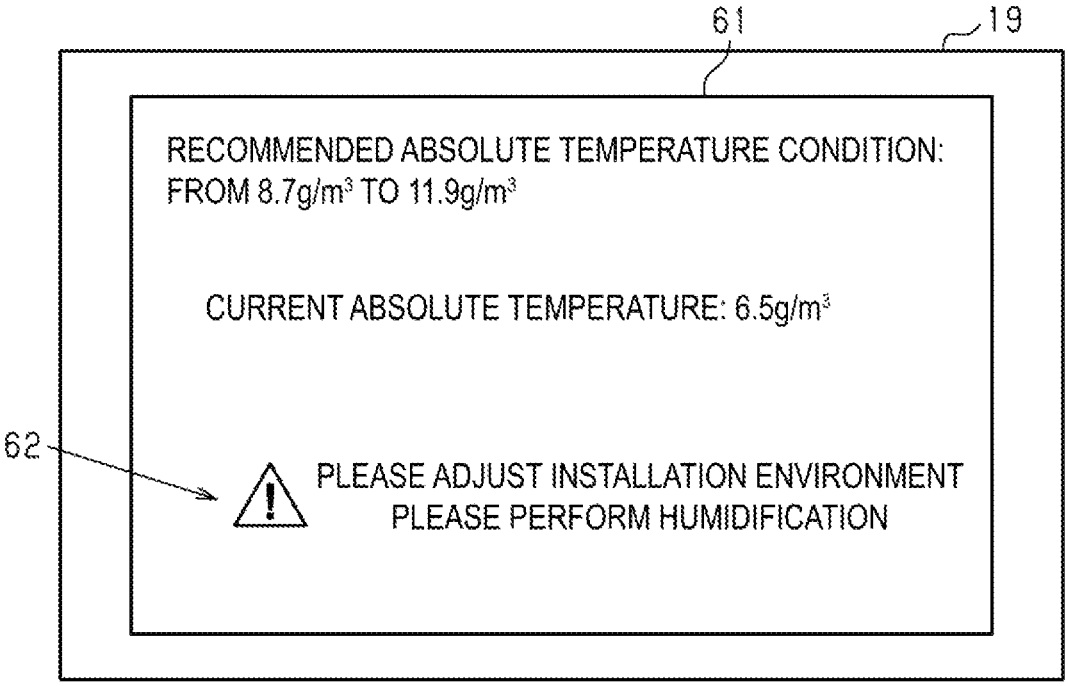
FIG. 6 is a schematic view of a display screen of a second embodiment.

As illustrated in FIG. 6, in the second embodiment, the display unit 19 displays the recommended absolute humidity conditions as the recommended condition. The display unit 19 displays the absolute humidity of the installation environment as an acquired parameter of the installation environment.

When the installation environment does not satisfy the recommended absolute humidity condition, the control unit 48 causes the display unit 19 to display a prompt for the installation environment to be adjusted. Here, the adjustment message 62 prompting adjustment of the installation environment is displayed on the display screen 61. The user confirms the adjustment message 62 and adjusts the installation environment.

The control unit 48 of the second embodiment causes the display unit 19 to display a display prompting humidification or dehumidification as the display prompting the installation environment to be adjusted. For example, when the absolute humidity of the installation environment exceeds the recommended absolute humidity condition, a display prompting the dehumidification of the installation environment is caused to be displayed on the display unit 19 as the adjustment message 62. When the absolute humidity of the installation environment is below the recommended absolute humidity condition, a display prompting the humidification of the installation environment is caused to be displayed on the display unit 19 as the adjustment message 62.

In the second embodiment, when the absolute humidity of the installation environment is above the recommended absolute humidity condition, a display prompting the cooling of the installation environment may be caused to be displayed on the display unit 19 as the adjustment message 62. By lowering the temperature of the installation environment, water vapor in the installation environment may condense. As a result, the humidity of the installation environment is reduced. In other words, dehumidification of the installation environment can be performed indirectly. This is useful for users who do not have a means of directly dehumidifying the installation environment.

In the second embodiment, when the absolute humidity of the installation environment is below the recommended absolute humidity condition, a display prompting the heating of the installation environment may be caused to be displayed on the display unit 19 as the adjustment message 62. By increasing the temperature of the installation environment, evaporation of the liquid present in the liquid ejecting device 11 is promoted. As a result, the humidity of the installation environment is increased. In other words, humidification of the installation environment can be performed indirectly. This is useful for users who do not have a means of directly humidifying the installation environment.

Next, the functions and effects of the second embodiment will be described. Note that according to the second embodiment, the above-described effects (5) to (8) can be achieved.

(9) For the proper operation of the liquid ejecting device 11, the humidity of the installation environment is more important than the temperature of the installation environment. When the humidity of the installation environment is high, the medium 99 becomes damp. In this case, the liquid ejected from the ejecting unit 28 may not properly fix to the medium 99. When the humidity of the installation environment is low, the air is dry. In this case, dust in the air readily adheres to the ejecting unit 28, and the ejecting unit 28 may not properly eject the liquid.

Relative humidity and absolute humidity are indicators of humidity. Relative humidity is temperature dependent, whereas absolute humidity is not temperature dependent. That is, when adjusting the installation environment based on the relative humidity, it is necessary to maintain a constant temperature. When adjusting the installation environment based on the absolute humidity, it is not necessary to maintain a constant temperature. Thus, the user can adjust the absolute humidity of the installation environment without worrying about the temperature of the installation environment. In this way, when the control unit 48 causes the display unit 19 to display a display prompting the adjustment of the installation environment on the basis of the parameter indicating the installation environment and the recommended absolute humidity condition, the installation environment is easily adjusted to the user.

The first embodiment and the second embodiment may be modified as described below. The first embodiment, the second embodiment, and the modified examples below may be implemented in combination within a range in which a technical contradiction does not arise.

The control unit 48 may causes the display unit 19 to display a display prompting the installation environment to be adjusted without the recommended condition being displayed on the display unit 19.

Figure 7:
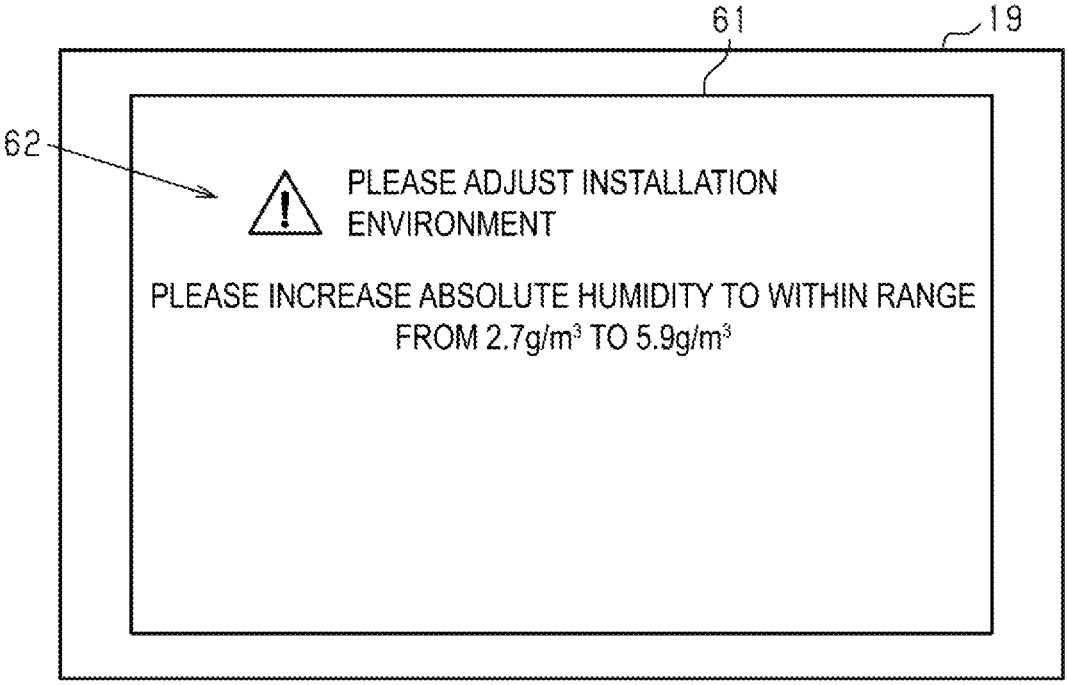
FIG. 7 is a schematic view of a modified example of the display screen.

As illustrated in FIG. 7, in this modified example, the control unit 48 displays the adjustment message 62 based on the acquired parameter and the stored recommended condition. For example, when the stored recommended absolute humidity condition is from 8.7 g/m$^3$ to 11.9 g/m$^3$ and the acquired absolute humidity of the installation environment is 6.0 g/m$^3$, then the control unit 48 displays "Please increase the absolute humidity to a range of from 2.7 g/m$^3$ to 5.9 g/m$^3$" as the adjustment message 62. In this case, the installation environment may be adjusted following the displayed adjustment message 62, making it easy for a user to adjust the installation environment. In this way, the installation environment can be adjusted by the user without the display unit 19 displaying the parameter of the installation environment and the recommended condition.

The control unit 48 causes predetermined information to be displayed on the display unit 19 to prompt the user to adjust the installation environment, but the user may be prompted to adjust the installation environment via a different method. For example, adjustment of the installation environment may be prompted via voice.

The recommended condition may be printed on the housing 12. In this case, the printed location on the housing 12 corresponds to the display unit 19.

The medium 99 is not limited to being a long paper fed from the roll body 100, and may be a single sheet. The medium 99 is not limited to paper, and may be a fabric or a plastic film or a metal film.

The liquid ejected by the ejecting unit 28 is not limited to ink, and may be, for example, a liquid material including particles of a functional material dispersed or mixed in liquid. For example, the ejecting unit 28 may eject a liquid material including a material such as an electrode material or a pixel material used in manufacture of liquid crystal display, an electroluminescent (EL) display, and a surface emitting display in a dispersed or dissolved form.

Part of the configuration or function of the liquid ejecting device 11 may be given to another device connected to the liquid ejecting device 11. More specifically, information displayed by the display unit 19 may be displayed on a display device externally connected to the liquid ejecting device 11. Furthermore, the control by the control unit 48 provided in the liquid ejecting device 11 may be performed by any control device externally connected to the liquid ejecting device 11. A part of the configuration or function of the control device 111 may be given to another device connected to the control device 111.

Hereinafter, technical concepts and effects thereof that are understood from the above-described embodiments and modifications will be described.

The liquid ejecting device includes the housing, the ejecting unit located in the housing that ejects liquid onto a medium, and the display unit that displays the recommended condition of the installation environment where the device is installed. The display unit displays, as a recommended condition, any of (a) a recommended temperature condition indicating a recommended temperature range, (b) a recommended relative humidity condition indicating a recommended relative humidity range, (c) a recommended absolute humidity condition indicating a recommended absolute humidity range, and (d) the recommended temperature condition and the recommended absolute humidity condition.

Generally, in the liquid ejecting device, a recommended installation environment recommended condition is determined to ensure proper operation. In a case where the display unit displays a recommended temperature condition as the recommended condition, the user adjusts the installation environment so that the temperature of the installation environment satisfies the recommended temperature condition. In a case where the display unit displays a recommended relative humidity as the recommended condition, the user adjusts the installation environment so that the relative humidity of the installation environment satisfies the recommended relative humidity condition. In a case where the display unit displays a recommended absolute humidity as the recommended condition, the user adjusts the installation environment so that the absolute humidity of the installation environment satisfies the recommended absolute humidity condition. In this way, when the display unit displays any of the conditions (a), (b), or (c), the installation environment can be easily adjusted by the user because there is only one information displayed by the display unit.

In a case where the display unit displays a recommended temperature condition and a recommended absolute humidity as the recommended condition, the user adjusts the installation environment so that the temperature of the installation environment satisfies the recommended temperature and the absolute humidity of the installation environment satisfies the recommended absolute humidity condition. Relative humidity is temperature dependent, whereas absolute humidity is not temperature dependent. That is, temperature and absolute humidity are each independent. As such, the user can separately adjust the temperature and the absolute humidity. In this way, when the display unit displays the condition (d), the installation environment can be easily adjusted by the user because the two information displayed by the display unit are independent of one another.

The liquid ejecting device may include the control unit that acquires a parameter indicating the installation environment, and the control unit may compare the acquired parameter with the stored recommendation condition, and in a case that the parameter does not satisfy the recommended condition, the control unit may cause the display unit to display a display prompting adjustment of the installation environment.

This configuration allows the user to know whether the installation environment needs to be adjusted.

In the liquid ejecting device described above, the control unit may store the absolute humidity condition as the recommended condition, and cause the display unit to display a display prompting the adjustment of the installation environment, based on the parameter and the absolute humidity condition.

This configuration allows the user to know whether the installation environment needs to be adjusted based on the absolute humidity condition.

The liquid ejecting device includes the housing, the ejecting unit located in the housing that ejects liquid onto a medium, the control unit that acquires the parameter indicating the installation environment where the device is installed, and the display unit. The control unit causes the display unit to display a display prompting the adjustment of the installation environment, based on the parameter and, as the recommended condition of the installation environment, a recommended absolute humidity condition indicating a recommended absolute humidity range.

Generally, in the liquid ejecting device, a recommended installation environment recommended condition is determined to ensure proper operation. For the proper operation of the liquid ejecting device, the humidity of the installation environment is more important than the temperature of the installation environment.

When the humidity of the installation environment is high, the medium becomes damp. In this case, the liquid ejected from the ejecting unit may not properly fix to the medium. When the humidity of the installation environment is low, the air is dry. In this case, dust in the air readily adheres to the ejecting unit, and the ejecting unit may not properly eject the liquid.

Relative humidity and absolute humidity are indicators of humidity. Relative humidity is temperature dependent, whereas absolute humidity is not temperature dependent. Thus, when adjusting the installation environment based on the relative humidity, it is necessary to maintain a constant temperature. When adjusting the installation environment based on the absolute humidity, it is not necessary to maintain a constant temperature. In other words, the user can adjust the absolute humidity of the installation environment without worrying about the temperature of the installation environment. In this way, when the control unit causes the display unit to display a display prompting the adjustment of the installation environment on the basis of the parameter indicating the installation environment and the recommended absolute humidity condition, the installation environment is easily adjusted to the user.

In the liquid ejecting device, the control unit may causes the display unit to display, as the display prompting adjustment of the installation environment, at least one of (e) a display prompting the humidification or dehumidification of the installation environment, or (f) a display prompting the heating or cooling of the installation environment, or combination thereof.

This configuration allows the user to know the specific method for adjusting the installation environment.

The liquid ejecting device described above may include the detection unit that detects the installation environment, and the control unit may acquire the parameter from the detection result detected by the detection unit.

This configuration allows the control unit to acquire the parameter without going through an external device.

In the liquid ejecting device, the control unit may store the adjustable range of the parameter, and in a case that the parameter does not satisfy the recommended condition, the control unit may cause the display unit to display a display prompting adjustment of the installation environment within the adjustable range.

This configuration allows adjustment to a proper installation environment to be prompted for based on an adjustable range.

In the liquid ejecting device, the control unit may observe the state variable of the temperature and the absolute humidity of the installation environment; after a prompt for the adjustment of the installation environment, may acquire the absolute humidity change information related to a change in the absolute humidity of the installation environment; may learn the condition associated with the change in absolute humidity of the installation environment after the prompt for adjusting of the installation environment, according to a training data set created based on the combination of the state variable, the content of processing of prompting adjustment of the installation environment, and the absolute humidity change information; and, based on the condition, may cause the display unit to display the information based on the state variable, the content of processing of prompting adjustment of the installation environment, and the absolute humidity change information.

In this way, information making it easy for the user to adjust the installation environment can be displayed.

The control device of the liquid ejecting device is a control device configured to communicate with the liquid ejecting device including the housing, the ejecting unit located in the housing that ejects liquid onto a medium, the control unit that acquires the parameter indicating the installation environment where the device is installed, and the display unit.

The control device observes the state variable of the temperature and the absolute humidity of the installation environment; after a prompt for the adjustment of the installation environment, acquires the absolute humidity change information related to a change in the absolute humidity of the installation environment; learns the condition associated with the change in absolute humidity of the installation environment after the prompt for adjusting of the installation environment, according to a training data set created based on the combination of the state variable, the content of processing of prompting adjustment of the installation environment, and the absolute humidity change information; and based on the condition, causes the control unit to perform processing of causing the display unit to display the information based on the state variable, the content of processing of prompting adjustment of the installation environment, and the absolute humidity change information.

This configuration allows information making it easy for the user to adjust the installation environment to be displayed.

What is claimed is:

1. A liquid ejecting device comprising:

a housing;

an ejecting unit located in the housing, the ejecting unit being configured to eject liquid onto a medium; and a display unit configured to display a recommended condition of an installation environment where the liquid ejecting device is installed, wherein the display unit displays as the recommended condition any of (a) a recommended temperature condition indicating a recommended temperature range, (b) a recommended relative humidity condition indicating a recommended relative humidity range, (c) a recommended absolute humidity condition indicating a recommended absolute humidity range, and (d) the recommended temperature condition and the recommended absolute humidity condition.

2. The liquid ejecting device according to claim 1, comprising a control unit configured to acquire a parameter indicating the installation environment, wherein the control unit compares the acquired parameter with the recommendation condition stored, and when the parameter does not satisfy the recommended condition, the control unit causes the display unit to display a display prompting adjustment of the installation environment.

3. The liquid ejecting device according to claim 2, wherein the control unit stores the absolute humidity condition as the recommended condition and causes the display unit to display the display prompting adjustment of the installation environment, based on the parameter and the absolute humidity condition.

4. The liquid ejecting device according to claim 3, wherein the control unit causes the display unit to display, as the display prompting adjustment of the installation environment, at least one of (e) a display prompting humidification or dehumidification of the installation environment, or (f) a display prompting heating or cooling of the installation environment, or combination thereof.

5. The liquid ejecting device according to claim 3, wherein the control unit observes a state variable of a temperature and an absolute humidity of the installation environment;

after a prompt for adjustment of the installation environment, acquires absolute humidity change information related to a change in the absolute humidity of the installation environment;

learns a condition associated with a change in absolute humidity of the installation environment after a prompt for adjustment of the installation environment, according to a training data set created based on a combination of the state variable, content of processing of prompting adjustment of the installation environment, and the absolute humidity change information; and based on the condition, causes the display unit to display information based on the state variable, the content of processing of prompting adjustment of the installation environment, and the absolute humidity change information.

6. The liquid ejecting device according to claim 2, comprising a detection unit configured to detect the installation environment, wherein the control unit acquires the parameter from a detection result detected by the detection unit.

7. The liquid ejecting device according to claim 2, wherein the control unit is configured to store an adjustable range of the parameter, and when the parameter does not satisfy the recommended condition, the control unit causes the display unit to display the display prompting adjustment of the installation environment within the adjustable range.

8. A liquid ejecting device comprising:

a housing;

an ejecting unit located in the housing, the ejecting unit being configured to eject liquid onto a medium;

a control unit configured to acquire a parameter indicating an installation environment where the liquid ejecting device is installed, and a display unit, wherein the control unit causes the display unit to display a display prompting adjustment of the installation environment, based on the parameter and, a recommended absolute humidity condition, as a recommended condition of the installation environment, indicating a recommended absolute humidity range.

9. The liquid ejecting device according to claim 8, wherein the control unit causes the display unit to display, as the display prompting adjustment of the installation environment, at least one of (e) a display prompting humidification or dehumidification of the installation environment, or (f) a display prompting heating or cooling of the installation environment, or any combination thereof.

10. The liquid ejecting device according to claim 8, comprising a detection unit configured to detect the installation environment, wherein the control unit acquires the parameter from a detection result detected by the detection unit.

11. The liquid ejecting device according to claim 8, wherein the control unit is configured to store an adjustable range of the parameter, and when the parameter does not satisfy the recommended condition, the control unit causes the display unit to display the display prompting adjustment of the installation environment within the adjustable range.

12. The liquid ejecting device according to claim 8, wherein the control unit observes a state variable of a temperature and an absolute humidity of the installation environment;

after a prompt for adjustment of the installation environment, acquires absolute humidity change information related to a change in the absolute humidity of the installation environment;

learns a condition associated with a change in absolute humidity of the installation environment after a prompt for adjustment of the installation environment, according to a training data set created based on a combination of the state variable, content of processing of prompting adjustment of the installation environment, and the absolute humidity change information; and based on the condition, causes the display unit to display information based on the state variable, the content of processing of prompting adjustment of the installation environment, and the absolute humidity change information.

13. A control device of a liquid ejecting device, the control device being configured to communicate with the liquid ejecting device including a housing, an ejecting unit located in the housing, the ejecting unit being configured to eject liquid onto a medium, a control unit configured to acquire a parameter indicating an installation environment where a device is installed, and a display unit, wherein the control device observes a state variable of a temperature and an absolute humidity of the installation environment;

after a prompt for adjustment of the installation environment, acquires absolute humidity change information related to a change in the absolute humidity of the installation environment;

learns a condition associated with a change in the absolute humidity of the installation environment after a prompt for adjustment of the installation environment, according to a training data set created based on a combination of the state variable, content of processing of prompting adjustment of the installation environment, and the absolute humidity change information; and based on the condition, causes the control unit to perform processing of causing the display unit to display information based on the state variable, the content of the processing of prompting adjustment of the installation environment, and the absolute humidity change information.

* * * * *